US005183391A

United States Patent [19]

Fiedler

[11] Patent Number: 5,183,391

[45] Date of Patent: Feb. 2, 1993

[54] VALVE PUMP

[75] Inventor: Robert R. Fiedler, Lincoln, Nebr.

[73] Assignee: Isco, Inc., Lincoln, Nebr.

[21] Appl. No.: 881,301

[22] Filed: May 6, 1992

Related U.S. Application Data

[63] Continuation of Ser. No. 621,075, Nov. 30, 1990, abandoned, which is a continuation-in-part of Ser. No. 522,679, May 11, 1990.

[51] Int. Cl.[5] ..... F04F 1/06

[52] U.S. Cl. ..... 417/118; 417/86; 417/126

[58] Field of Search ..... 417/86, 118, 121, 122, 417/126, 139, 478

[56] References Cited

U.S. PATENT DOCUMENTS

| | | | |
|---|---|---|---|
| 3,408,949 | 11/1968 | Hart, Jr. | 417/126 |
| 4,050,854 | 9/1977 | Hereford et al. | 417/121 |
| 4,749,337 | 6/1988 | Dickinson et al. | 417/478 |

*Primary Examiner*—Richard A. Bertsch

*Assistant Examiner*—Michael I. Kocharov

*Attorney, Agent, or Firm*—Vincent L. Carney

[57] ABSTRACT

To provide smoother operation of a gas-operated purge pump, the pump housing receives a standpipe closed by a low-density, floatable check valve element at the inlet of a standpipe within the housing. Periodically, at timed intervals, air is forced through an air conduit into the housing. If there is liquid in the housing, a check valve element floats upwardly because it is less dense than the liquid and mounted for movement to and away from the valve seat. While it is off of the valve seat, the air forces water into the standpipe and it moves upwardly until the chamber of the tubular pump housing is free of the liquid, at which time the check valve drops back into position and seats to prevent further flow of liquid. Upon termination of the pumping of gas pressure, the check valve in the pump housing inlet is free to move under the pressure of water in the well and the pump housing chamber again fills with fluid, causing the valve element to lift and permitting flow of water into the standpipe.

3 Claims, 5 Drawing Sheets

27A
87A
80A
21B
40B
34B
32B
23B
37B
86A
92A
90A
94A
88A
82A
84A
60A
25A
24B
26B
48B
21B
52A
46B
60B
62B
40B
57B
56B
44B
39A
34B
32B
37B
23B

VALVE PUMP

RELATED CASES

This case which is a continuation of application Ser. No. 07/621,075, filed Nov. 30, 1990, abandoned, is a continuation in part of United States patent application Ser. No. 07/522,679 filed May 11, 1990, in the name of Robert R. Fiedler.

BACKGROUND OF THE INVENTION

This invention relates to pumps and more particularly to gas-operated liquid pumps such as for example pumps of the type referred to as well water purge pumps.

One class of pumps includes a tubular pump housing, a liquid inlet, a standpipe and an air conduit. The pump housing is sealed at two ends except: (1) there is a liquid inlet at one end controlled by a check valve so that liquid may flow into the housing such as from a well but not out of the housing back into the well through the inlet; (2) the standpipe extends downwardly into the housing and there is a check valve in the standpipe; and (3) the air conduit enters the housing. With this arrangement, water flows into the housing through the inlet and then air is pumped into the housing to force the liquid upwardly through the standpipe.

In a prior art pump of this type, air is pumped into the pump housing to force water up through the standpipe to the surface. The user learns when the pump housing is empty of water by the presence of water being pumped from the standpipe followed by air or by the volume of water pumped from the standpipe. When the pump housing is empty, more water is permitted to enter and the cycle repeated until sufficient water has been pumped from the well. For example, in a purging operation of the well, a number of volumes of the well specified by the Environmental Protection Agency is removed.

This prior art pump has a disadvantage in that air separates slugs of water moving up the standpipe to cause waste time as slugs of water are expelled separated by slugs of air.

In another prior art pump of this type, a bladder pump is suspended within the well water purge pump so that, as the well water purge pump operates, water is expelled, passing through the center of the bladder pump. With other valve connections, the bladder pump operates within the casing and inside of the well water purge pump to draw samples after purging. One prior art pump of this type is disclosed in U.S. Pat. No. 4,701,107.

The prior art pumps of this category have some disadvantages in that the central member of the bladder pump complicates the air lift pump and the standpipe is difficult to purge completely.

SUMMARY OF THE INVENTION

Accordingly, it is an object of the invention to provide a novel valved pump.

It is a further object of the invention to provide a novel purge pump.

It is a further object of the invention to provide a novel technique for using gases to pump water through a pump.

It is a still further object of the invention to provide a novel technique for purging wells.

It is a still further object of the invention to provide a novel valving arrangement for pumps.

In accordance with the above and further objects of the invention, a pump includes a housing, a housing inlet, a housing-inlet check valve, a gas source, a standpipe and a valve arrangement that opens upon sensing water and closes upon sensing air. The valve arrangement includes a standpipe check valve located at the inlet of the standpipe within the housing. The standpipe check valve arrangement prevents flow from the standpipe into the housing and includes a valve element which permits liquid to flow into the standpipe when there is liquid in the housing but closes once the liquid is removed so that, upon pressurization of the housing by the gas source, liquid flows into the standpipe and may be pumped from the housing to the surface for discharge. With this arrangement, pressurized gas may continually force liquid into the standpipe to evacuate the housing but once the housing is empty of liquid, the standpipe is blocked within the housing so that gas does not enter the standpipe.

In operation, the housing may be lowered into a well. Within the well, water flows into the housing through the inlet but is not able to flow out of the housing back into the well because of a check valve biased to permit inward flow of water but not outward flow of water.

Periodically, at timed intervals, gas such as air under pressure is forced through an air conduit into the housing. In the preferred embodiment, if there is liquid in the housing, a check valve element of the means for sensing liquids floats upwardly because it is less dense than the liquid and mounted for movement to and away from the valve seat. While the valve element is off of the valve seat, the pressurized gas forces water into the standpipe and it moves upwardly until the chamber of the tubular pump housing is free of the liquid, at which time the check valve drops back into position and seats on the valve seat to prevent further flow of liquid. Upon release of the gas pressure, the check valve in the pump housing inlet is free to move under the pressure of water in the well and the pump housing chamber again fills with water, causing the valve element to lift and permitting flow of water into the standpipe.

The standpipe check valve arrangement should include: (1) a floatable means of lower density than the liquid being pumped which, when there is liquid in the housing, permits the liquid to enter the standpipe and when the pump housing chamber is evacuated of liquid, closes to block any substantial air from entering the standpipe; and (2) a second check valve positioned so that the standpipe remains full of liquid and does not drain back into the housing. This can conveniently be accomplished by two members, which are: (1) a check valve to prevent liquid from flowing out of the standpipe once it has entered; and (2) a floatable check valve element and cooperating valve seat that opens when the pump chamber is full of liquid of greater density than the valve element.

In one embodiment, the housing is extended and has at a lower end a passageway which communicates with the check valve. At the lower end of the passageway, there is a second check valve and a bladder pump so that, upon air actuation, a sample can be drawn and pumped through the first check valve. With this arrangement, both sample drawing and purging may be accomplished without assembly complications in a simple pump.

From the above description, it can be understood that the pump of this invention has several advantages such as: (1) it is faster in operation since the cycle time is increased by avoiding the upward movement of air in the standpipe; and (2) it avoids the wasting of compressed air or other gas by preventing its escape from the outlet of the standpipe at the surface.

SUMMARY OF THE DRAWINGS

The above noted and other features of the invention will be better understood from the following detailed description when considered with reference to the accompanying drawings in which.

DETAILED DESCRIPTION

Figure 1:
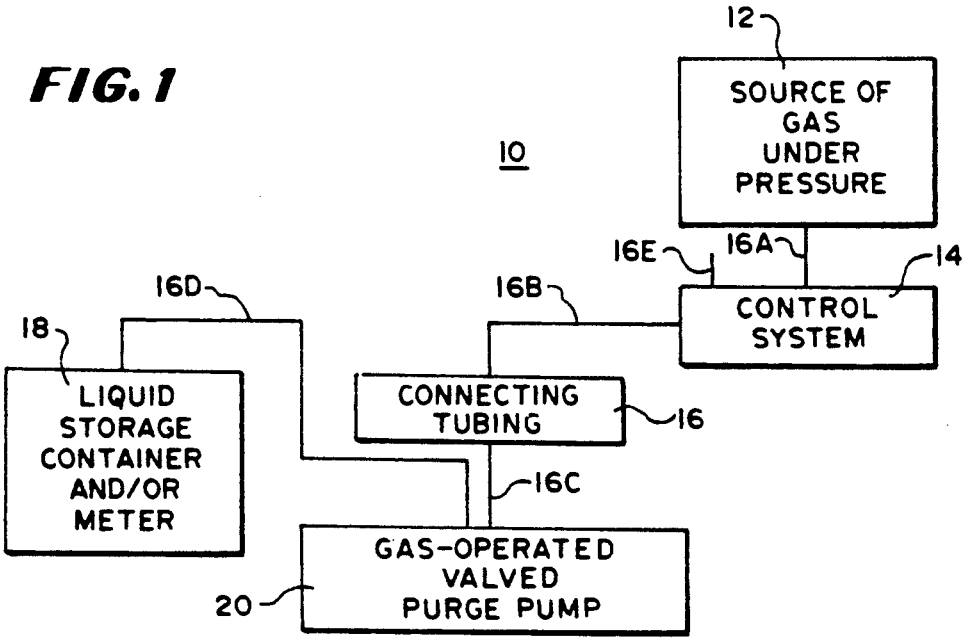
FIG. 1 is a block diagram of a pumping system in accordance with the invention.

In FIG. 1, there is shown a pumping system 10 having a source of gas under pressure 12, a control system 14, certain connecting tubing 16, a liquid storage container and/or meter 18 and a gas-operated valved purge pump 20. The gas-operated valved purge pump 20 communicates: (1) with the source of gas under pressure 12 through connecting tubing 16C, the control system 14 and connecting tubing 16A; and (2) with the liquid storage container 18 through outlet tubing 16D.

To pump liquid, the control system 14 alternately pressurizes and depressurizes the gas-operated valved purge pump 20 by connecting it alternately to source of gas under pressure 12 through connecting tubing 16A and 16C from the source of connecting tubing 16 and to atmosphere through the vent tube 16E. With this arrangement, liquid is pumped through the outlet tubing 16D into the liquid storage container and/or meter 18. The control system 14 may be a manual valve or equipment such as that referred to in U.S. Pat. No. 4,810,172 or any other manual or automatic source for alternately pressurizing the conduit 16B and releasing pressure through the conduit 16B.

In the preferred embodiment, the gas-operated valved purge pump 20 has a diameter of approximately 44 millimeters and a length of approximately 1.2 meters. It operates on a gas pressure substantially within the range of 20 pounds per square inch and 120 pounds per square inch.

Figure 2:
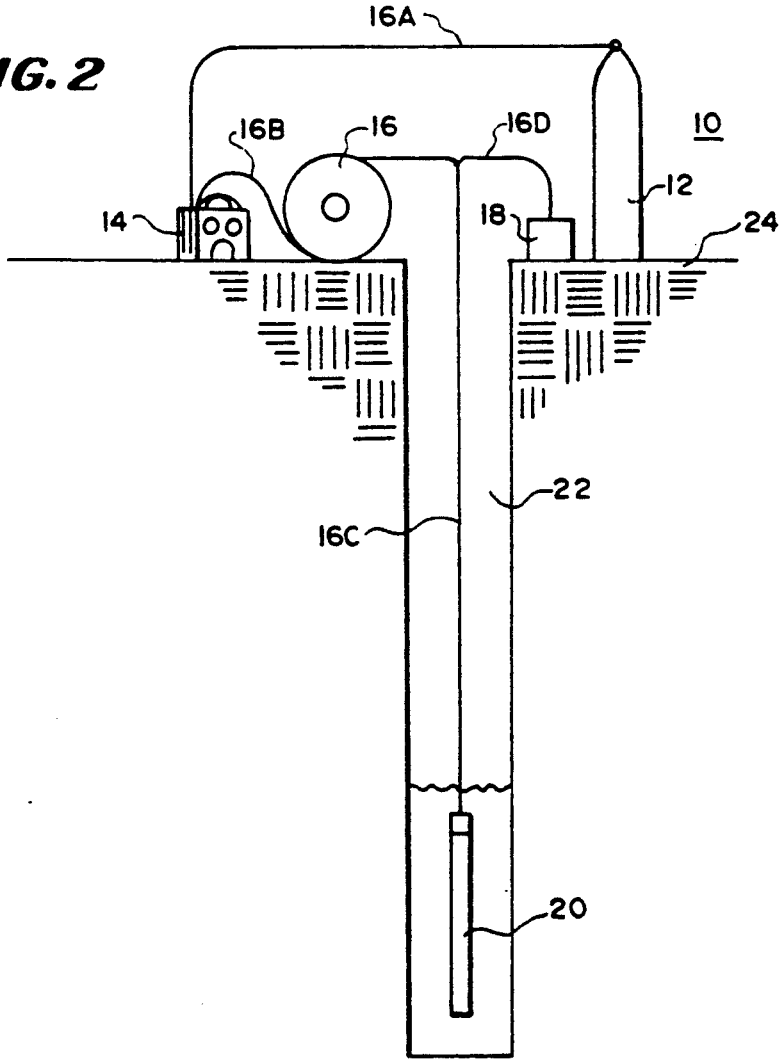
FIG. 2 is a schematic diagram showing one manner in which the pumping system of FIG. 1 is utilized.

In FIG. 2, there is shown a schematic diagram illustrating one application of the gas-operated valved purge pump 20. In this use of the gas-operated valved purge pump 20, it communicates through the connecting tubing 16 through a control box containing the control system 14 and the connecting tubing 16C to force liquid upwardly from a well 22 to the liquid storage container and/or meter 18 under pressure from a pressurized source of gas 12. With this arrangement, liquid may be pumped from a well 22 under ground 24 such as for purging the well by removing several volumes for sampling the quality of water or for other purposes. While this pump is shown as a well purge pump, it may be used for any other purpose such as for sampling water or for pumping other liquids.

Figure 3:
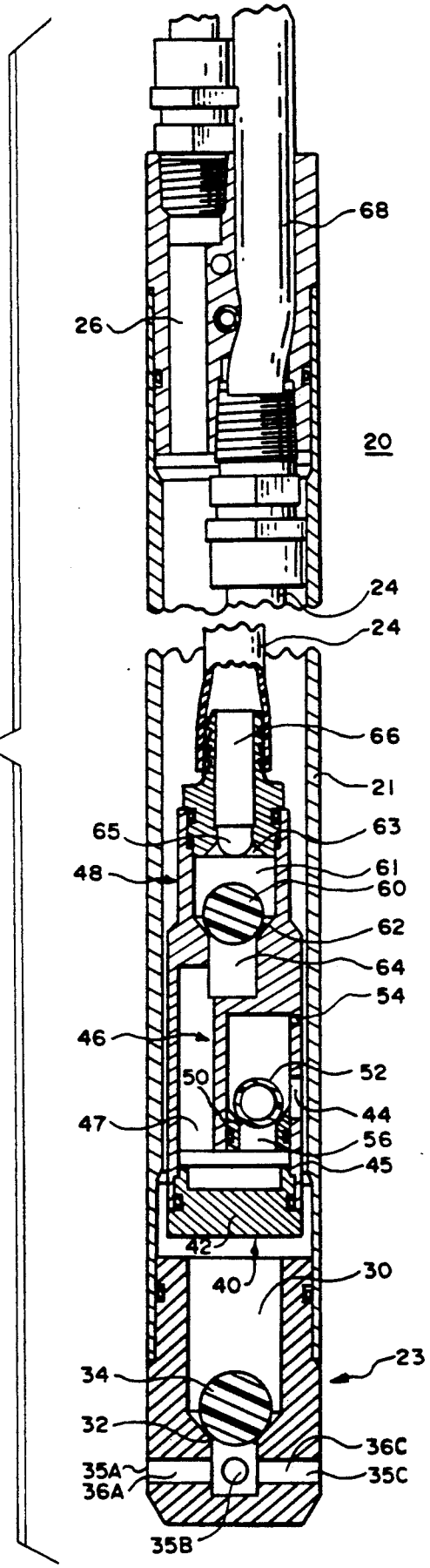
FIG. 3 is a sectional fragmentary view of a pump in accordance with the invention.

In FIG. 3, there is shown a sectional view, partly broken away, of a pump 20 used to evacuate the water such as in a well purging operation, evacuating it several times before taking a sample for environmental monitoring purposes. The pump 20 includes a pump housing 21, a well liquid inlet assembly 23, a flexible standpipe 24, an air conduit 26, and a standpipe valve assembly 40, as its principal parts.

The standpipe 24 and air conduit 26 communicate with a pump chamber within the pump housing 21 at one end and communicate with the surface at the other end where the air conduit 26 may have pressurized gas applied to it periodically to pressurize the pump chamber. As the pump chamber is pressurized, liquid within it is pumped through the standpipe 24 from the chamber of the pump and forced upwardly to the surface. Liquid to be pumped enters the chambers of the pump through the well liquid inlet assembly 23.

The well liquid inlet assembly 23 conforms to the inner shape of the pump housing 21 and fits therein. It includes: (1) four aligned inlet ports, three of which are shown in FIG. 3 at 35A-35C; (2) four passageways, two of which are shown at 36A and 36C respectively; (3) a water check valve assembly having a valve seat 32 and valve element 34 positioned so that the inlet ports and passageways communicate with the valve seat 32 permitting water to flow upwardly beyond the valve element 34 and into the purge pump housing 21, but not in the opposite direction outwardly from the pump housing 21. With this arrangement, unless the pump chamber within the pump housing 21 of the pump 20 is pressurized to hold the check valve element 34 downwardly or the chamber is full, liquid may flow through the ports and passageways upwardly through the check valve inlet and into the pump chamber within the pump housing 21.

The standpipe valve assembly 40 communicates with the standpipe 24 at the lower end of the standpipe and lower end of pump chamber within the pump housing 21 of the pump 20. The standpipe valve 40 includes a standpipe inlet plug 42, a standpipe inlet port 44, a liquid sensing valve 46 and a standpipe check valve 48. The plug 42 seals the bottom of a tubular outer wall of the standpipe, which tubular outer wall includes the standpipe inlet port 44 which communicates directly with the liquid sensing valve 46 to permit liquid from the inlet assembly 23 to flow through the passageway 45, the inlet port 44, the valve opening 56, the passageway 47 into the standpipe housing and through the standpipe check valve 48 when water is in the pump housing 21.

While any type of liquid sensing valve may be used, in the preferred embodiment, the liquid sensing valve 46 is a check valve having a valve seat 50, a valve member 52, a vent port 54 and an outlet port 56. The valve seat 50 is located slightly below the level of the inlet port 44 and the valve element 52 is positioned in a valve cage between the vent port 54, the inlet port 44 and the valve seat 50 so that: (1) when the valve element 52 is against the valve seat 50, it blocks outlet port 56 leading to the standpipe, but liquid may pass through the inlet port 44 and the vent port 54; but (2) when raised from the valve seat 50, the valve element 52 moves upwardly forcing liquid out of the vent port 54 when it is above the inlet port 44 and permits fluid to enter the inlet port 44 and flow downwardly through the valve seat 50 and the outlet port 56 into the standpipe.

The vent port 54 and the space between the valve element 52 and cage walls are large enough to permit liquid to escape from between the valve element 52 and the upper portion of the cage walls in sufficient quantity so that the volume of liquid above the valve element 52 is reduced to allow the valve element 52 to move upwardly away from the valve seat 50.

The valve element 52 is less dense than water or any other liquid that the pump is intended to pump. Consequently, when liquid flows into the vent port 54 and against the inlet port 44, the valve element 52 floats upwardly and the liquid can flow downwardly through the valve seat 50 and outlet port 56 into the standpipe. On the other hand, when the gas flows downwardly, the valve element 52 is more dense than the gas and it drops against the valve seat 50 blocking the outlet port 56 so that the liquid cannot flow through the outlet port 56 but can flow through the vent port 54. The cage member is solid and water tight except for the vent port 54 to the interior of the pump housing 21, the inlet port 44 and the outlet port 56 and only the outlet port 56 communicates with the standpipe. The valve element 52 and the inlet to the valve cage are both above the valve seat and valve opening but the valve opening communicates with the standpipe that extends upwardly above the valve element, valve seat and valve opening.

The valve element 52 must be sufficiently light to float free when the pump 20 is first inserted in a well and there is air in the conduit leading from the valve seat 50 up through the opening 66, the standpipe 24 and conduit 68 to the surface. In the preferred embodiment, the valve element 52 is a hollow polypropylene sphere $\frac{3}{4}$ inch in diameter which has an average specific gravity of 0.5 but it should be lower than 0.8 to permit fast enough floating of the valve element as the pump is lowered so that the valve element is not held on the valve seat against the force of its buoyancy by the head of pressure from the well before the conduit is full of water.

If an arrangement is made to fill the conduit leading from the valve seat 50 to the surface of the water in the well, then the average specific gravity need only be less than one. In the preferred embodiment, the diameter of the valve opening 56 is $\frac{3}{8}$ of an inch and the valve element 52 rises sufficiently to break the seal when the water line is $\frac{3}{8}$ of an inch above the portion of the valve element 52 that forms a seal blocking the valve opening 56.

The check valve 48 is mounted in series between the outlet of the standpipe and the liquid sensing valve 46. It includes in the preferred embodiment a valve element 60, a valve seat 62, a valve inlet port 64 communicating with the opening 66 of the standpipe 24 which, in turn communicates with the conduit 68. The valve cage 61 that communicates with the opening 66 of the standpipe 24 has milled away portions 63 to enlarge the opening 66 for smooth flow and yet provide stops 65 for the check valve element 60.

The outlet port 56 of the liquid sensing valve 46 is connected by a vertical opening to the valve inlet port 64 of the check valve assembly 48. This valve inlet port 64 permits liquid to flow through the valve seat 62, with the valve element 60 being adapted to fit within the valve seat 62 so that when liquid flows through the liquid sensing valve 46 upwardly, it may flow through the check valve assembly 48 into the opening 66 of the standpipe 24 but water within the standpipe forces the valve element 60 into the valve seat 62 by its weight to prevent downward flow.

Figure 4:
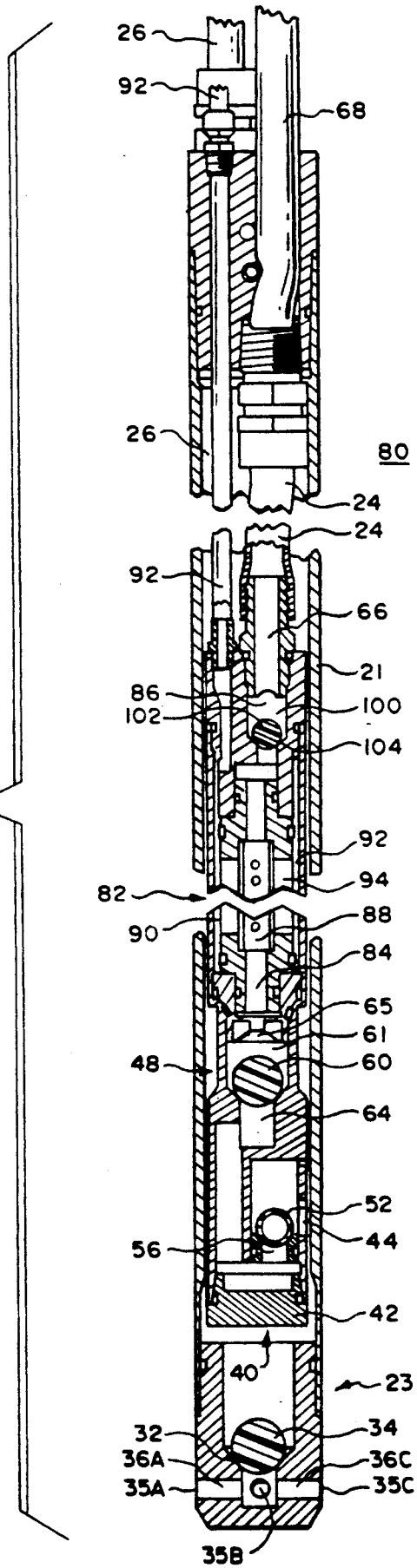
FIG. 4 is a sectional fragmentary view of another embodiment of pump in accordance with the invention.

In FIG. 4, there is shown a longitudinal sectional view of another embodiment of pump 80 similar to the embodiment of FIG. 3 and incorporating substantially the same identical parts, indicated by the same numbers in FIG. 4 as in FIG. 3, but also including within it a bladder pump 82 for drawing samples. The bladder pump 82 is positioned in series with the purge pump within the housing wall 21 and may be located above or below the purge pump either between the inlet assembly 23 and the purge pump or between the purge pump and the opening 66 of the standpipe 24 so that liquid flows through both the purge pump and the bladder pump 82. It includes a central passageway so that liquid flows between the inlet assembly 23 and the standpipe 24 regardless of whether the purge pump is forcing the liquid upwardly or the bladder pump 82 is forcing the liquid upwardly.

The bladder pump 82 includes, in the preferred embodiment, an inlet 84, an outlet 86, a center passage support 88, a bladder 90, an air conduit 92, and a pump chamber 94. In this embodiment, the bladder pump inlet 84 communicates with the outlet 65 of the purge pump and the bladder pump outlet 86 communicates with the opening 66 of the standpipe 24 so that fluid pumped under air pressure through the purge pump flows upwardly through the center passage support 88 within the cylindrical bladder 90 enclosing the pump chamber 94 and into the standpipe 24.

To cause a sample to be drawn, air under pressure is applied to the air conduit 92 from the surface to force the bladder 90 to stretch inwardly and compress fluid between the check valve 60 and the standpipe 24, thus forcing it upwardly. After forcing fluid upwardly, the air may be relaxed to return the bladder 90 to its larger diameter, at which time fluid flows past a valve 48, causing the check valve 60 to be lifted.

To prevent liquid from dropping back into the bladder pump 82, the outlet 86 is closed by another check valve 100 including a valve element 102 within a valve seat 104, which is forced upwardly by liquid flowing into the standpipe 24 but permitted to drop down to seal the valve opening should water in the standpipe 24 be moved in the opposite direction.

This type of bladder pump is not in itself part of the invention, except insofar as it cooperates with the purge pump to permit samples to be drawn immediately after purging without withdrawing one pump and inserting another. It may be operated from the same source of gas under pressure 12 (FIG. 1) as the bladder pump or from a separate source by switching the gas flow from one conduit to another in the case of the use of the same source of gas pressure. While many prior art types of bladder pumps may be used sized appropriately to fit within the housing, it is advantageous for such a bladder pump to have a central support member, such as the cage 88 within the pump chamber 100 to maintain spacing for the flow of fluid. It is also advantageous for the pump to have a relatively large central passageway available during the purge operation.

In both the embodiment of FIG. 3 and the embodiment of FIG. 4, the check valve 52 must be floatable in water and should be capable of floating even though the pump has been newly inserted into a well and contains air within the standpipe 24 all the way down to the valve opening through the valve seat under the valve element 52. For this purpose, the average specific gravity of the valve element 52, with its total volume including any hollow center being divided into its weight to reach this average specific gravity, should be sufficiently low so that the buoyancy of the valve in the liquid above the valve element is sufficient to elevate it and break a seal to the valve opening even though there may be air in the valve opening at 56. This specific gravity should be lower than that necessary for the valve element to float unless other arrangements are made for initially breaking the seal the first time the pump is placed in the well, such as by the provision of an opening for flooding the valve seat with water under pressure similar to that exerted by the well water flowing on top of the valve element.

To cause the valve element to break the seal of its own buoyancy, the specific gravity of the valve element should be sufficiently low to enable it to float before liquid entering its cage reaches any surface that enables downward pressure in it by the water. If this is not possible, the specific gravity should be lower or equal to one minus a ratio. The ratio is equal to the depth of the water in the well creating the head of pressure upon its surface multiplied by the area of the valve port divided by the valve of the valve element. The shape of the valve element and opening may vary but in the preferred embodiment, the valve element is spherical and the valve opening cylindrical. Although diameters are being used as the normal parameter for area in this description, because most valve elements are spherical and most valve openings cylindrical, in the case of other shapes such as a square, the parameters used may be the sides of a square or other appropriate dimensions.

During pumping cycles, the pressure is lowered after water has been forced into the standpipe and when water enters the housing, there is water in the valve opening so the element floats free as the water enters.

Figure 5:
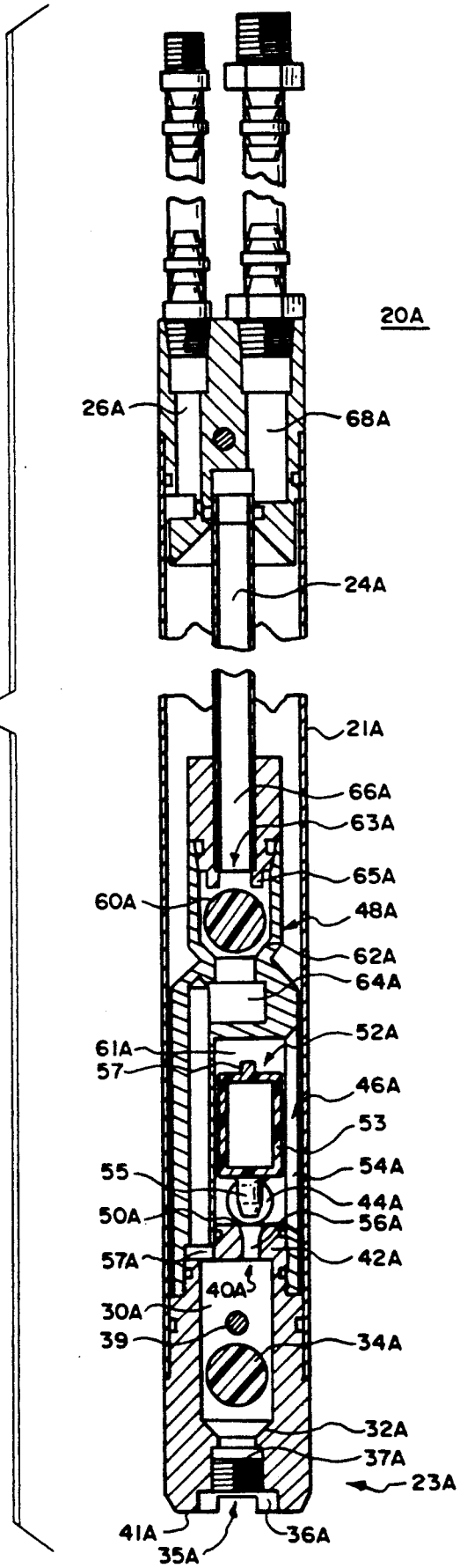
FIG. 5 is a sectional fragmentary view of still another embodiment of the invention.

In FIG. 5, there is shown a longitudinal, fragmentary, sectional view, partly broken away, of a pump 20A similar to the pump 20 of FIG. 3 having a pump housing 21A, a well liquid inlet assembly 23A, a flexible standpipe 24A, an air conduit 26A and a standpipe valve assembly 40A as its principal parts.

The standpipe 24A and air conduit 26A communicate with a pump chamber within the pump housing 21A at one end and communicate with the surface at the other end where the air conduit 26A may have pressurized gas applied to it periodically to pressurize the pump chamber. As the pump chamber is pressurized, the liquid within it is pumped through the standpipe 24A from the chamber of the pump and is forced upwardly to the surface. Liquid to be pumped enters the chambers of the pump through the well liquid inlet assembly 23A.

The well liquid inlet assembly 23A conforms to the inner shape of the pump housing 21A and fits therein. It includes: (1) a slot 35A extending transversely across an end 41A of the pump; (2) a centrally located counterbore 36A in the end 41A; (3) a tapped hole 37A; (4) a valve seat 32A and a valve element 34A as its principal parts. The valve element 34A is approximately ½ inch in diameter and fits within the valve seat 32A to block the tapped hole 37A which extends outwardly to the counterbore 36A to permit the entrance of liquid. A pin 39 extends through the inlet assembly 23A to hold the valve element 34A against rising excessively but permits it to rise a sufficient distance for liquid to enter.

The inlet assembly 23A includes outer walls forming a cylinder and has: (1) at one end the slot 35A, the counterbore 36A, the tapped hole 37A and the valve seat 32A wherein liquid may enter the housing; and (2) at the other end a valve outlet port 56A within the housing passing through the upper wall and communicating with the standpipe valve 24A through the opening 57A and valve 48A wherein liquid may flow between the inlet assembly 23A and the standpipe valve assembly 40A. The opening into the standpipe valve assembly 40A at 57A on one side permits and fluid to flow therethrough from the valve outlet port 56A of the standpipe assembly 40A during a pressurization cycle before the valve element 52A closes the valve outlet 56A.

The standpipe valve assembly 40A communicates with the standpipe 24A at the lower end of the standpipe and lower end of the pump chamber within the pump housing 21A of the pump 20A. The standpipe valve assembly 40A cooperates with the valve outlet port 56A which is within the top wall of the inlet assembly 23A and includes the standpipe inlet port 44A which communicates directly with a liquid sensing valve 46A to permit liquid to flow into the standpipe housing and through a standpipe check valve 48A when water is in the pump housing 21A.

While any type of liquid sensing valve may be used, in the preferred embodiment, the liquid sensing valve 46A is a check valve having: (1) a valve seat 50A formed in the upper wall of the inlet assembly 23A and communicating with the outlet port 56A; (2) a valve member 52A; and (3) a vent slot 54A.

The valve seat 50A is located slightly above the level of the bottom of the inlet port 44A and the valve element 52A is positioned in a valve cage that includes the valve slot 54A, the inlet port 44A 90 degrees from the vent slot 54A and the valve seat 50A so that: (1) when the valve element 52A is against the valve seat 50A, it blocks the outlet port 56A connecting the standpipe and the inlet assembly 23A, but liquid may pass through the inlet port 44A and vent slot 54A; but (2) when raised from the valve seat 50A, the valve element 52A moves upwardly forcing liquid out of the vent slot 54A when it is above the inlet port 44A and permits fluid to enter the inlet port 44A and flow downwardly through the valve seat 50A and to the outlet port 56A into the standpipe in a manner similar to that of the embodiment of FIG. 3.

The vent slot 54A and the space between the valve element 52A and the cage walls are large enough to permit liquid to escape between the valve element 52A and the upper portion of the cage walls in sufficient quantity so that the volume of liquid above the valve element 52A is reduced to allow the valve element 52A to move upwardly away from the valve seat 50A.

The valve element 52A is less dense than water or any other liquid that the pump is intended to pump. Consequently, when liquid flows into the vent slot 54A and against the inlet port 44A, the valve element 52A floats upwardly and the liquid can flow downwardly through the valve seat 50A and outlet port 56A into the standpipe. On the other hand, when the gas flows downwardly, the valve element 52A is more dense than the gas and it drops against the valve seat 50A blocking the outlet port 56A so that the liquid cannot flow through the outlet port 56A but can flow through the vent slot 54A.

The cage member is solid and water tight except for the vent slot 54A to the interior of the pump housing 21A, the inlet port 44A and the outlet port 56A and only the outlet port 56A communicates with the standpipe. The valve element 52A and the inlet to the valve cage are both above the valve seat 50A and valve opening but the valve opening communicates with the standpipe that extends upwardly above the valve element, valve seat 50A and valve opening.

The valve element 52A must be sufficiently light to float free when the pump 20A is first inserted in a well and there is air in the conduit leading from the valve seat 50A up through an opening 66A, the standpipe 24A and a conduit 68A to the surface. In the preferred embodiment, the valve element 52A is a substantially cylindrical hollow polypropylene float having a cylindrical central body portion 53 with a downwardly extending cylindrical nose 55 and an upwardly extending cylindrical detent 57. The nose 55 is sized to fit sealingly within the outlet port 56A when the valve element 52A is seated and the upwardly extending cylindrical detent 57 is sized to space the cylindrical valve element 52A a short distance from the upper wall to prevent sticking therein and blockage of the vent slot 54A.

The valve element 52A in the preferred embodiment should have an average specific gravity of 0.5 and should be lower than 0.8 to permit fast enough floating of the valve element 52A as the pump 20A is lowered so that the valve element 52A has sufficient buoyancy to be lifted from the valve seat 50A. If an arrangement is made to fill the conduit leading from the valve seat 50A to the surface of the water in the well, then the average specific gravity need only be less than 1. In the preferred embodiment, the diameter of the valve outlet port 56A is ⅜ of an inch and the valve element 52A rises sufficiently to break the seal when the water line is ½ of an inch above the upper surface of the upper wall of the inlet assembly 23A through which the outlet port 56A extends.

The valve cage is also cylindrical and the distance between the outside diameter of the body portion 53A of the valve element 52A and the inner walls of the valve cage is sufficiently small so that the nose 55 remains aligned evenly with the outlet port 56A. In the preferred embodiment, this space is 1/16 of an, inch but it should always fall between light thousandths of an inch and ¼ of an inch depending on the size of the lateral walls of the central body portion 53.

This arrangement avoids an unexpected problem that has occurred with the embodiment of FIG. 3. That unexpected problem occurs at certain depths which cause fluid flow between the valve element 52 (FIG. 3) and the outlet port 56 to be of such a velocity that the valve element does not float properly during depressurization or refilling through ports 56 and 44. The water pulls it in with a venturi effect. This phenomenon occurs when water is flowing through the inlet 40 and avoids the complete floatation of the valve element 52. This phenomenon is avoided in the embodiment of FIG. 5 because the valve element nose 55 pushes the main body up out of the flow stream where the low pressure of high velocity water (i.e. venturi effect) cannot reach it.

The check valve 48A is mounted in series between the outlet of the standpipe and the liquid sensing valve 46A. It includes, in the preferred embodiment, a valve element 60A, a valve seat 62A, a valve inlet port 64A communicating with the opening 66A of the standpipe 24A which, in turn, communicates with the conduit 68A. The valve cage 61A that communicates with the opening 66A of the standpipe 24A has cut away portions at 63A to enlarge the opening 66A for smooth flow and yet provide stops 65A for the check valve element 60A.

The outlet port 56A of the liquid sensing valve 46A is connected by a vertical inlet port 64A of the check valve assembly 48A. This valve inlet port 64A permits liquid to flow through the valve seat 62A with the valve element 60A being adapted to fit within the valve seat 62A so that when liquid flows through the liquid sensing valve 46A and proceeds through the chamber 30A of the inlet assembly 23A upwardly through the conduit 68A, it may flow through the check valve assembly 48A into the opening 66A of the standpipe 24A but water within the standpipe 24A forces the valve element 60A into the valve seat 62A by its weight to prevent downward flow.

The communication of the chamber 30A within the inlet assembly 23A with the liquid sensing valve 46A through the outlet port 56A of the liquid sensing valve 46A avoids an unexpected problem that occassionally occurs in the embodiment of pump 20 described in connection with FIG. 3. At certain depths in that embodiment, the velocity of the liquid being pumped between the check valve 48 and the liquid level sensing valve 46 has sufficient inertia and momentum to create a vacuum between the two check valves when the liquid sensing valve 46 closes. This vacuum exerts pressure that holds both of them closed even though the liquid level rises to a sufficient height to normally float the check valve 52 upon refilling.

In the new embodiment, when the valve elements 60A and 52A are seated by the inertial forces, a slight vacuum is created in the chamber 30A. This chamber 30A communicates directly with the liquid level sensing valve 46A. The slight pressure caused by the inertia causes the valve element 34A to move upwardly a slight distance, permitting the flow of liquid upwardly through the outlet 57A to remove vacuum pressure and permit the valve element 52A to freely float when the liquid reaches an appropriate level.

Figures 6, 7:
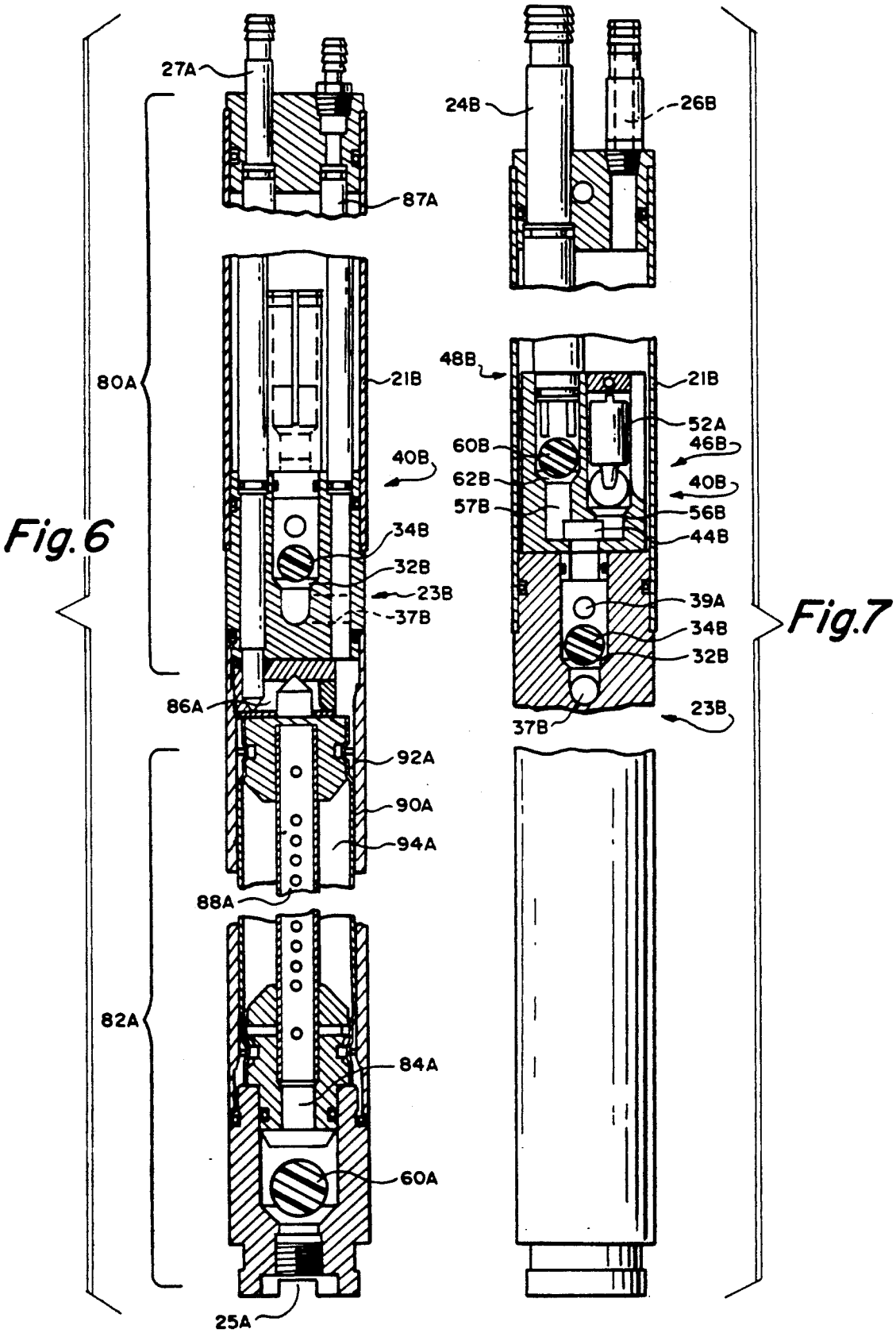
FIG. 6 is a sectional fragmentary view of still another embodiment of pump in accordance with the invention.
FIG. 7 is a fractional longitudinal sectional view from the embodiment of FIG. 6 from a direction 90 degrees removed from that of FIG. 6.

In FIGS. 6 and 7, there are shown two longitudinal sectional views taken 90 degrees from each other of another embodiment of pump 80A. The embodiment of FIGS. 5 and 6 are similar to the embodiment of FIG. 4 and incorporates substantially the same identical parts, indicated by the same numbers in FIGS. 6 and 7 as in FIG. 4, but instead of including a bladder pump 82 for drawing samples with the housing of the purge pump, it has two separate pumps 80A and 82A, one under the other in the preferred embodiment each with its own inlet and outlet. The bladder pump 82A is positioned below the purge pump 80A but may be located above, below or on the side of the purge pump.

The bladder pump 82A includes a bladder pump inlet assembly 25A, a central passageway support 88A, an outlet line 27A, an inlet passageway 84A, a bladder 90A and an air conduit 92A. Liquid flows during pumping between the inlet assembly 25A, the central passageway support 88A and outlet line 27A. To cause a sample to be drawn, air under pressure is applied to the air conduit 92A from the surface through conduit 87A to force the bladder 90A to stretch inwardly and compress fluid between the check valve 60A and the central passageway support 88A, thus forcing it upwardly through the conduit 27A. After forcing fluid upwardly, the air may be relaxed to return the bladder 90A to its larger diameter, at which time fluid flows through the inlet assembly 25A causing the check valve element 60A to be lifted.

This type of bladder pump is not in itself part of the invention, except insofar as it cooperates with the purge pump 80A to permit samples to be drawn immediately after purging without withdrawing one pump and inserting another. It may be operated from the same source of gas under pressure 12 (FIG. 1) as the bladder pump or from a separate source by switching the gas flow from one conduit to another in the case of the use of the same source of gas pressure. While many prior art types of bladder pumps may be used, each sized appropriately to fit onto a purge pump, it is advantageous for such a bladder pump to have a central support member, such as the cage 88A within the pump chamber to maintain spacing for the flow of fluid.

During pumping cycles, the pressure is lowered after water has been forced into the standpipe, and when water enters the housing, there is water in the valve opening so the element floats free as the water enters. In the embodiment of FIGS. 6 and 7, the purge pump 80A is similar to the pump 20 of FIG. 3 and the pump 20A of FIG. 5 and has a pump housing portion 21B, a well liquid inlet assembly 23B, a standpipe 24B, an air conduit 26B and a standpipe valve assembly 40B as its principal parts.

The standpipe 24B and air conduit 26B communicate with a pump chamber within a pump housing 21B at one end and communicate with the surface at the other end where the air conduit 26B may have pressurized gas applied to it periodically to pressurize the pump chamber. As the pump chamber is pressurized, the liquid within it is pumped through the standpipe 24B from the chamber of the pump and is forced upwardly to the surface. Liquid to be pumped enters the chambers of the pump through the well liquid inlet assembly 23B.

The well liquid inlet assembly 23B includes: (1) a passageway 37B through the pump housing 21B with parts not shown in FIGS. 6 and 7 but similar to passageway parts of the inlet assembly 23A of FIG. 5; (2) a valve seat 32B and a valve element 34B; and (3) a pin 39A through the inlet assembly 23B to hold the valve element 34B against rising excessively but to permit it to rise a sufficient distance for liquid to enter; and (4) an outlet 56B within the housing passing through the upper wall and communicating with the standpipe valve assembly 40B wherein liquid may flow between the inlet assembly 23B and the standpipe valve assembly 40B. An additional opening into the standpipe valve assembly 40B is located at 57B on one side to permit fluid to flow therethrough from the valve outlet port 56B of the standpipe assembly.

The standpipe valve assembly 40B communicates with the standpipe 24B at the lower end of the standpipe and lower end of the pump chamber within the pump housing 21B of the pump section 80A. The standpipe valve 40B cooperates with the valve outlet port 56B which is within the top wall of the inlet assembly 23B and includes the standpipe inlet port 44B which communicates directly with the liquid sensing valve 46B to permit liquid to flow into the standpipe housing and through a standpipe check valve 48B when water is in the pump housing 21B. The liquid sensing valve 46B is the same as the liquid sensing valve 44A of embodiment of FIG. 5.

The check valve 48B is mounted in series between the outlet of the standpipe and the liquid sensing valve 46B. It includes, in the preferred embodiment, a valve element 60B, a valve seat 62B, a valve inlet port 64B communicating with the opening 66B of the standpipe 24B which, in turn, communicates the conduit 26B. It is similar in structure with the check valve assembly 48A in the embodiment of FIG. 5.

To prevent liquid from dropping back from outlet standpipe 24B, the standpipe is closed by another check valve 48B including a valve element 60B within a valve seat 62B, which valve element 60B is forced upwardly by liquid flowing into the standpipe 24B but permitted to drop down to seal the valve opening should water in the standpipe 24B try to move in the opposite direction.

In the embodiment of FIG. 3, the embodiment of FIG. 4, and the embodiment of FIGS. 6 and 7, the check valves 52, 53 and 52A respectively, must be floatable in water and should be capable of floating even though the pump has been newly inserted into a well and contains air within the standpipe 24 all the way down to the valve opening through the valve seat under the corresponding one of the valve elements 52, 53 and 52A. For this purpose, the average specific gravity of the valve element 52, 53 and 52A with its total volume including any hollow center being divided into its weight to reach this average specific gravity, should be sufficiently low so that the buoyancy of the valve in the liquid above the valve element is sufficient to elevate it and break a seal to the valve opening even though there may be air in the valve opening at 56B.

This specific gravity should be lower than that necessary for the valve element to float unless other arrangements are made for initially breaking the seal the first time the pump is placed in the well, such as by the provision of an opening for flooding the valve seat with water under pressure similar to that exerted by the well water flowing on top of the valve element. This design is substantially the same as that of the embodiment of FIG. 5.

Although a preferred embodiment of the invention has been described with some particularity, many modifications and variations in the preferred embodiment may be made without deviating from the invention. Therefore, it is to be understood that, within the scope of the appended claims, the invention may be practiced other than as specifically described.

What is claimed is:

1. A purge pump comprising:

an enclosure;

means for applying gas under pressure to the enclosure;

pump inlet means for permitting the flow of liquid under ground from a well into said enclosure;

said pump inlet means including first check valve means whereby liquid is permitted to flow into said enclosure but not permitted to flow out of said enclosure;

conduit means for permitting liquid to flow out of said enclosure as gas is applied to said enclosure;

said conduit means including a conduit-means inlet portion;

said conduit-means inlet portion including liquid level sensing means for permitting liquid to flow from the enclosure into said conduit means when a substantial amount of liquid is within said enclosure;

said liquid level sensing means including second check valve means having a valve element, a valve seat and a valve housing;

said valve element having a density less than said liquid but more than said gas, whereby said valve element floats free of said valve seat in the presence of said liquid but not in the presence of said gas;

said conduit-means inlet portion including a conduit-means inlet opening and a third check valve means for permitting liquid to flow into said conduit means;

said conduit means extending between said enclosure and the surface of the ground;

said valve element including a nose part fitting within said valve seat;

a valve opening communicating with said conduit means and said valve housing;

a valve housing inlet opening communicating with said enclosure and said valve housing wherein water and gas may flow from said enclosure into said valve housing;

the distance between the walls of the valve housing and valve element being between 8 thousandths inch and ¼ inch;

said valve housing inlet opening, valve opening and valve element being arranged with respect to each other so that the valve element is lifted sufficiently by the liquid before said valve element nose leaves said valve opening to avoid venturi effects from liquid flowing past the valve element between said valve housing inlet means and said valve opening;

said conduit-means inlet opening connecting said first check val valve means and third check valve means wherein negative pressure between said second check valve means and third check valve means may pull said first check valve means from its valve seat whereby pressure is released that otherwise would tend to hold said first check valve means and third check valve means closed.

2. A pump in accordance with claim 1 in which the pump is intended to be dropped to a predetermined level under water where the second check valve means is to open, and the valve element has a specific density and size and the valve opening is dimensional so that the specific density is at least as low as one minus a ratio having a numerator equal to the level under water multiplied by the area of the valve opening and the denominator is equal to the volume of the valve element.

3. A combined purge pump and sample pump comprising:

an enclosure;

means for applying gas under pressure to the enclosure;

pump inlet means for permitting the flow of liquid under ground from a well into said enclosure;

said pump inlet means including first check valve means whereby liquid is permitted to flow into said enclosure but not permitted to flow out of said enclosure; and conduit means for permitting liquid to flow out of said enclosure as gas is applied to said enclosure;

said conduit means including a conduit-means inlet portion;

said conduit-means inlet portion including liquid level sensing means for permitting liquid to flow from the enclosure into said conduit means when a substantial amount of liquid is within said enclosure;

said liquid level sensing means including second check valve means having a valve element, a valve seat and a valve housing;

said valve element having a density less than said liquid but more than said gas, whereby said valve element floats free of said valve seat in the presence of said liquid but not in the presence of said gas;

said conduit-means inlet portion including a conduit-means inlet opening and a third check valve means for permitting liquid to flow into said conduit means;

said conduit means extending between said enclosure and the surface of the ground;

a bladder pump communicating in series with said liquid level sensing means, said bladder pump including a conduit for applying gas thereto, an expandable bladder and an outer casing wall extending laterally from said liquid level sensing means;

said valve element including: a nose part fitting within said valve seat; a valve opening communicating with said conduit means and said valve housing; a valve housing inlet opening communicating with said enclosure and said valve housing wherein water and gas may flow from said enclosure into said valve housing;

the distance between the walls of the valve housing and valve element being between 8 thousandths inch and ¼ inch;

said valve housing inlet opening, valve opening and valve element being arranged with respect to each other so that the valve element is lifted sufficiently by the liquid before said valve element nose leaves said valve opening to avoid venture effects from liquid flowing past the valve element between said valve housing inlet means and said valve opening;

said conduit-means inlet opening connecting said firs check valve means and third check valve means wherein negative pressure between said second check valve means and third check valve means may pull said first check valve means from its valve seat whereby pressure is released that otherwise would tend to hold said first check valve means and third check valve means closed.

* * * * *